US007780408B2

(12) United States Patent
Lazzarato et al.

(10) Patent No.: US 7,780,408 B2
(45) Date of Patent: Aug. 24, 2010

(54) FLOW STRAIGHTENER FOR AXIAL FANS, PARTICULARLY FOR CONDITIONING SYSTEMS

(75) Inventors: Moreno Lazzarato, Brugine (IT); Maristella Bregantin, legal representative, Brugine (IT); Marco Lazzarato, legal representative, Brugine (IT); Giuliano Grigoletto, Brugine (IT); Stefano Michieli, Sant'Angelo Di Piove (IT); Andrea Dalla Zuanna, Padua (IT)

(73) Assignee: Emerson-Network Power S.R.L., Piove Di Sacco (IT)

( * ) Notice: Subject to any disclaimer, the term of this patent is extended or adjusted under 35 U.S.C. 154(b) by 777 days.

(21) Appl. No.: 11/653,214

(22) Filed: Jan. 16, 2007

(65) Prior Publication Data

US 2007/0166153 A1 Jul. 19, 2007

(30) Foreign Application Priority Data

Jan. 18, 2006 (IT) ..... PD20060005 U

(51) Int. Cl.
*F04D 29/54* (2006.01)

(52) U.S. Cl. ..... 415/211.2; 415/220

(58) Field of Classification Search ..... 415/211.2, 415/220, 191; 454/4, 16
See application file for complete search history.

(56) References Cited

U.S. PATENT DOCUMENTS

| | | | | |
|---|---|---|---|---|
| 2,371,360 | A * | 3/1945 | Silverberg | 415/211.2 |
| 2,653,757 | A | 9/1953 | Segalman | |
| 3,467,312 | A * | 9/1969 | Mehr | 239/127.3 |
| 3,861,140 | A * | 1/1975 | Krabacher | 60/262 |
| 6,280,317 | B1 * | 8/2001 | Przilas et al. | 454/184 |
| 6,874,497 | B2 * | 4/2005 | Yeung | 126/299 E |
| 7,241,214 | B2 * | 7/2007 | Sixsmith | 454/17 |
| 2004/0228728 | A1 | 11/2004 | Kuo | |

FOREIGN PATENT DOCUMENTS

| | | |
|---|---|---|
| DE | 12 91 090 B | 3/1969 |
| JP | 57 186098 A | 11/1982 |

* cited by examiner

*Primary Examiner*—Ninh H Nguyen
(74) *Attorney, Agent, or Firm*—Modiano & Associati; Albert Josif; Daniel J. O'Byrne

(57) ABSTRACT

A flow straightener for axial fans particularly for conditioning systems, being constituted by a plurality of flat deflection walls, which form a substantially star-shaped profile which is adapted to be arranged coaxially and proximate to the impeller of the axial fan with which it is associated.

8 Claims, 3 Drawing Sheets

FLOW STRAIGHTENER FOR AXIAL FANS, PARTICULARLY FOR CONDITIONING SYSTEMS

The present invention relates to a flow straightener for axial fans, particularly for conditioning system.

BACKGROUND OF THE INVENTION

In conditioning and refrigeration technologies, fans of the axial type are used when it is necessary to generate air flows characterized by a high flow-rate/head ratio, i.e., when large amounts of air have to be moved over short paths or have to pass through means which have a high load loss (such as for example a high-efficiency filtration system).

The operation of a free axial impeller, shown schematically in FIG. 1, generates two volumes A and B at different pressures, which are divided by the disk-like band C occupied by the impeller in its rotary motion.

This simplified diagram reveals the first inherent limitation of a generic axial fan, i.e., the parasitic recirculation of air which occurs on the entire perimeter of the disk generated by the rotation of the impeller.

One of the limitations shown by the use of axial fans for the distribution of cold air in enclosed spaces is the shape of the output air jet.

This is one of the reasons why axial fans are mainly used in suction mode, since the manner in which the output air jet is constituted is of limited importance for the application.

In practice, fans arranged so as to work by aspirating air from above to propel it downward generate an output air flow which has the shape of a widening conical spiral.

The geometric characteristics of the profile formed by said flow depend on the constructive characteristics of the impeller and on the rotation conditions.

Further, the presence of the motor centrally with respect to the impeller generates a sort of ascending central recirculation, i.e., back toward the impeller, which facilitates the conical widening of the descending air flow.

Flow straighteners are currently commercially known which are designed to be arranged downstream of the impellers when a flow which is as cylindrical as possible has to be obtained.

These straighteners can be of various kinds.

A first type of straightener consists of straighteners constituted by a grille with rather fine mesh and having a certain thickness.

Such grille-type straighteners have the advantage of being compact and the possible disadvantage of a high load loss.

A second type of straightener consists of straighteners constituted by a static set of vanes which cooperate with the vanes of the impeller of the axial fan with which they are associated.

This second type of straightener, although being better than the first one, can be very bulky, but most of all is generally very expensive, since the profile of the vanes must be studied and built accurately also according to the profile of the vanes of the impeller of the fan.

Further, the design effort for manufacturing these straighteners with static vanes leads to solutions with the same inherent problem as the fans whose flow is to be corrected, and are therefore optimized for certain rotation condition.

A conditioning unit to be installed on a ceiling, provided with at least one axial fan which is arranged so as to work by aspirating air from above in order to push it downward, likewise generates an output air flow which has a conical spiral shape as described above.

The problem to be solved for these conditioning units is therefore the orientation of the air flow which exits downward.

Considering the cone-like widening of the flow and the recirculation caused by the central position of the motor of the impeller, said conical opening reduces the penetration of cold air to the lower layers of the cooled volume and facilitates the mixing of the layers of air at different temperatures, reducing the stratification effect which is generally sought and desired for the controlled conditioning of an enclosed space.

For these conditioning units it is therefore essential to obtain an air flow which is as concentrated as possible, so that the entire flow generated by the axial fan reaches the lower layers of the cooled volume, reducing recirculations and improving cold distribution, balancing it especially horizontally and stratifying it vertically.

Another problem for these conditioning units with an axial fan with descending vertical action is said parasitic air recirculation, which occurs on the entire perimeter of the disk formed by the rotation of the impeller.

This recirculation in fact reduces the efficiency of said conditioning unit and consequently has a negative effect also on the other associated machines, such as remote condensing units, water cooling units with air condensation, and the like.

SUMMARY OF THE INVENTION

The aim of the present invention is to provide a flow straightener for axial fans particularly for conditioning systems which is capable of solving the drawbacks of known types of straightener.

Within this aim, an object of the present invention is to provide a flow straightener which is capable of reducing the above cited problems linked to the correct operation of a ceiling-mounted conditioning unit with vertical axial fan.

Another object of the present invention is to provide a straightener which limits parasitic recirculations of air, rendering the air flow that exits from the axial fan less conical than the air flows that exit from known types of straightener.

Another object of the present invention is to provide a flow straightener which improves the stratification of the air in the enclosed space in which the conditioning unit with which it is associated works.

Another object of the present invention is to provide a flow straightener which can also be applied to conditioning units which already exist and are already in operation.

A further object of the present invention is to provide a flow straightener for axial fans particularly for conditioning systems which can be manufactured cheaply with known systems and technologies.

This aim and these and other objects, which will become better apparent hereinafter, are achieved by a flow straightener for axial fans particularly for conditioning systems, characterized in that it is constituted by a plurality of flat deflection walls, which form a substantially star-shaped profile or element which is adapted to be arranged coaxially and proximate to the impeller of the axial fan with which it is associated.

BRIEF DESCRIPTION OF THE DRAWINGS

Further characteristics and advantages of the invention will become better apparent from the following detailed description of three preferred but not exclusive embodiments thereof, illustrated by way of non-limiting example in the accompanying drawings, wherein.

DESCRIPTION OF THE PREFERRED EMBODIMENTS

Figure 1:
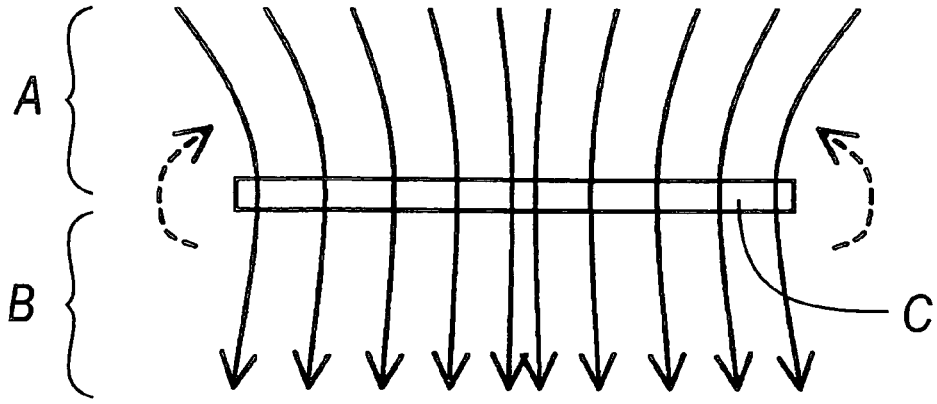
FIG. 1 is a schematic view of the operation of a free axial impeller.

With reference to the figures, a flow straightener for axial fans particularly for conditioning systems according to the invention is generally designated by the reference numeral 10 in its first embodiment, which is shown in FIGS. 2 to 5.

Figure 2:
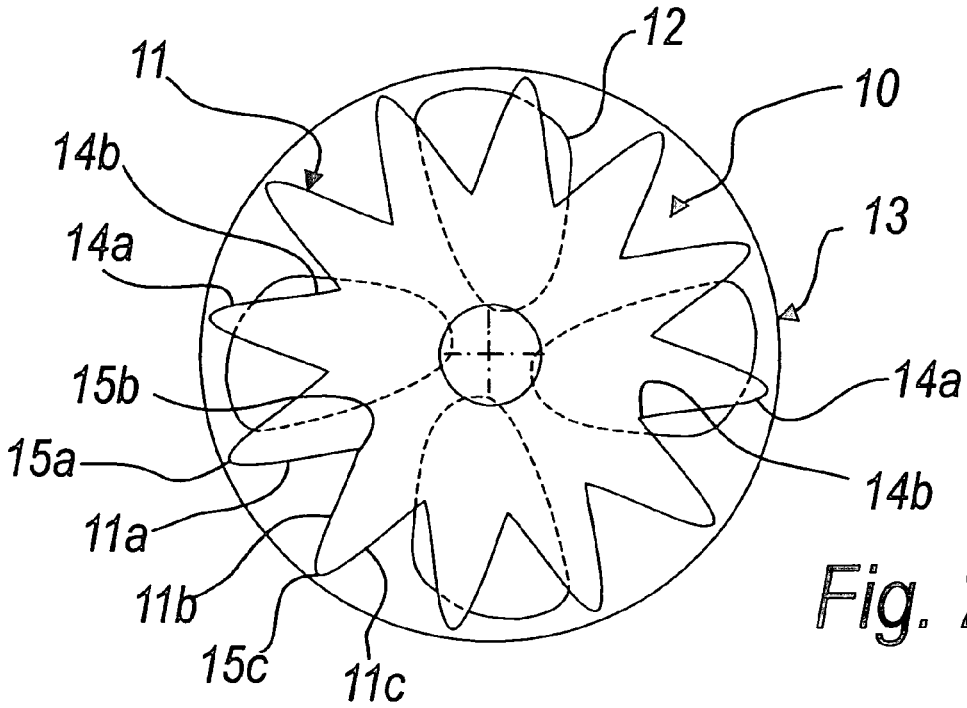
FIG. 2 is a front view of an axial fan to which a straightener according to the invention in a first embodiment is applied.
Figure 3:
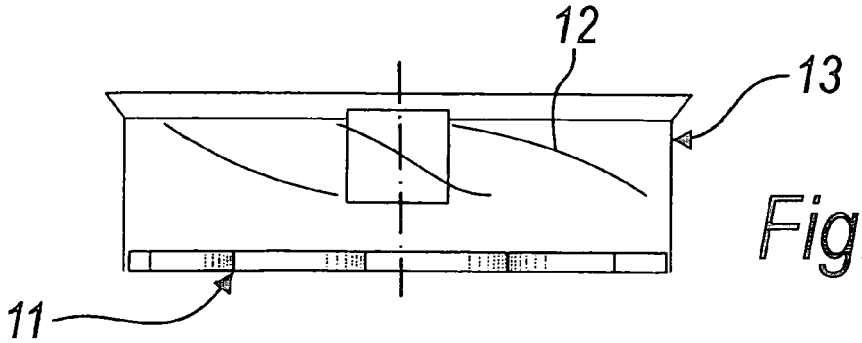
FIG. 3 is a side view of an axial fan to which a straightener according to the invention is applied.

The straightener 10 is constituted by a plurality of flat deflection walls, of which three 11*a*, 11*b*, 11*c* are shown in FIG. 2 by way of example and form a substantially star-shaped profile or element 11.

The profile or element 11 has a central axis thereof and is adapted to be arranged coaxially to an impeller 12 of an axial fan 13 with which it is associated and proximate to said impeller.

The thickness extension of the profile 11 lies substantially in the direction of the axis of the impeller 12 and therefore vertically in the case of an axial fan of a ceiling-mounted conditioning unit.

The flat walls 11*a*, 11*b*, 11*c* are each constituted by a metallic lamina which is joined by its ends 14*a* and 14*b* to a contiguous additional wall.

The regions where the walls 11*a*, 11*b* and 11*c* join form consecutive vertices 15*a*, 15*b*, 15*c*, which are directed alternately toward the inside and toward the outside of the profile 11 formed by the walls.

The profile or element 11 is continuous.

In the first embodiment, the vertices 15*a*, 15*b*, 15*c* are substantially angular, and two substantially straight walls 11*a*, 11*b* and 11*c* join thereat.

Figure 6:
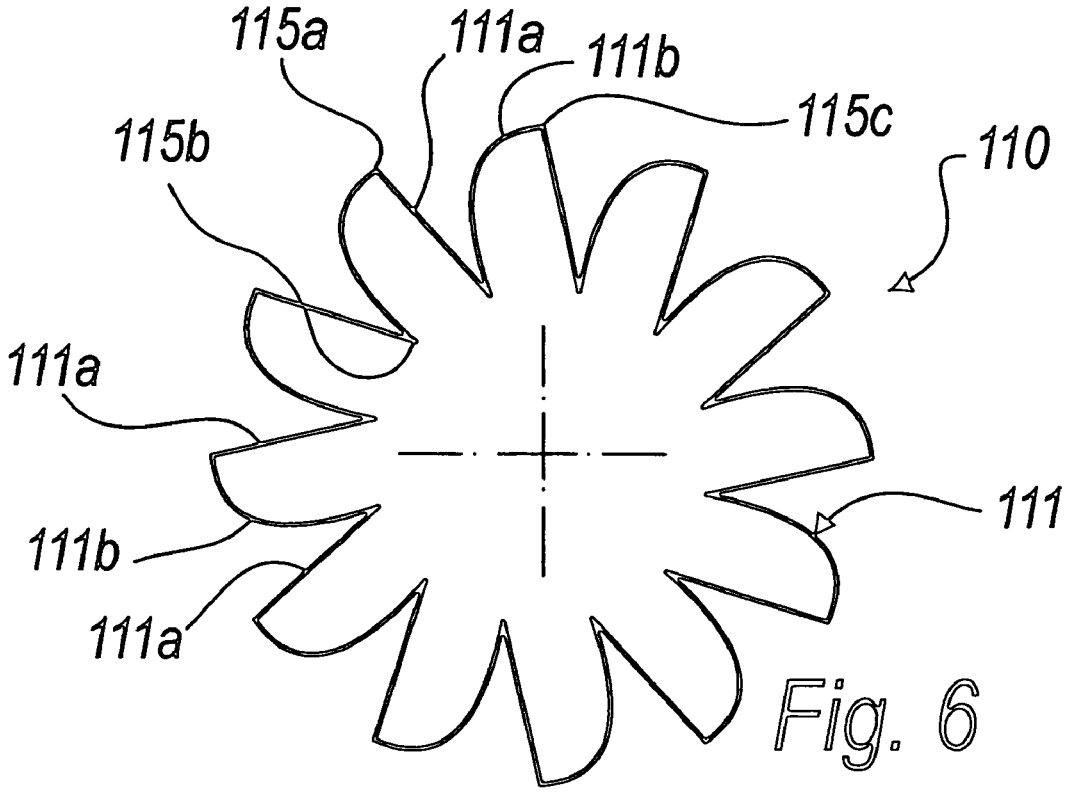
FIG. 6 is a view of a second embodiment of a straightener according to the invention.

In a second embodiment of the straightener according to the invention, shown in FIG. 6 and designated by the reference numeral 110 therein, the vertices 115*a* onward are substantially angular, and a substantially straight wall 111*a* and a curved wall 111*b* join thereat.

Figure 7:
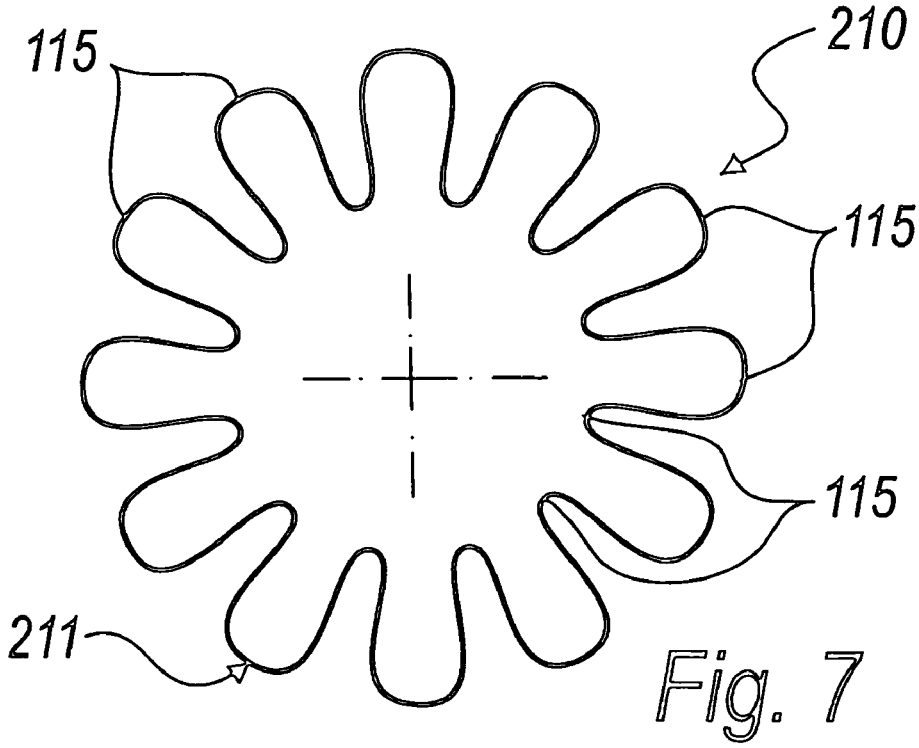
FIG. 7 is a view of a third embodiment of a straightener according to the invention.

In a third embodiment of the straightener according to the invention, shown in FIG. 7 and designated by the reference numeral 210 therein, the vertices 115 are curved.

The profile or element 11, 111 and 211 which provides the straightener according to the invention is obtained by bending a strip of metal plate.

As an alternative, the straightener 10, 110, 210 can be obtained by molding plastic material.

Figure 4:
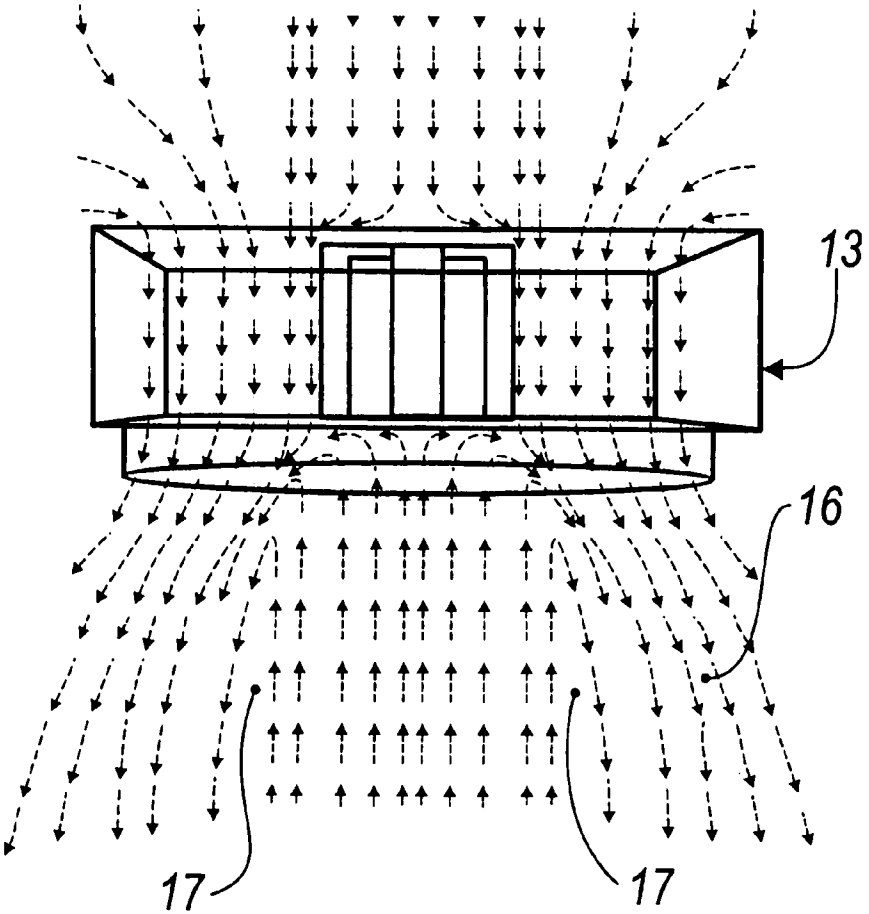
FIG. 4 is a side view of a measurement of the behavior of the air flow determined by an axial fan without a flow straightener.

FIG. 4 is a side view of a measurement of the behavior of the air flow determined by an axial fan 13 without a flow straightener.

The conical shape, which opens downward, of the profile 16 of the faster air flow and the extent of recirculation regions 17 are clearly visible.

Figure 5:
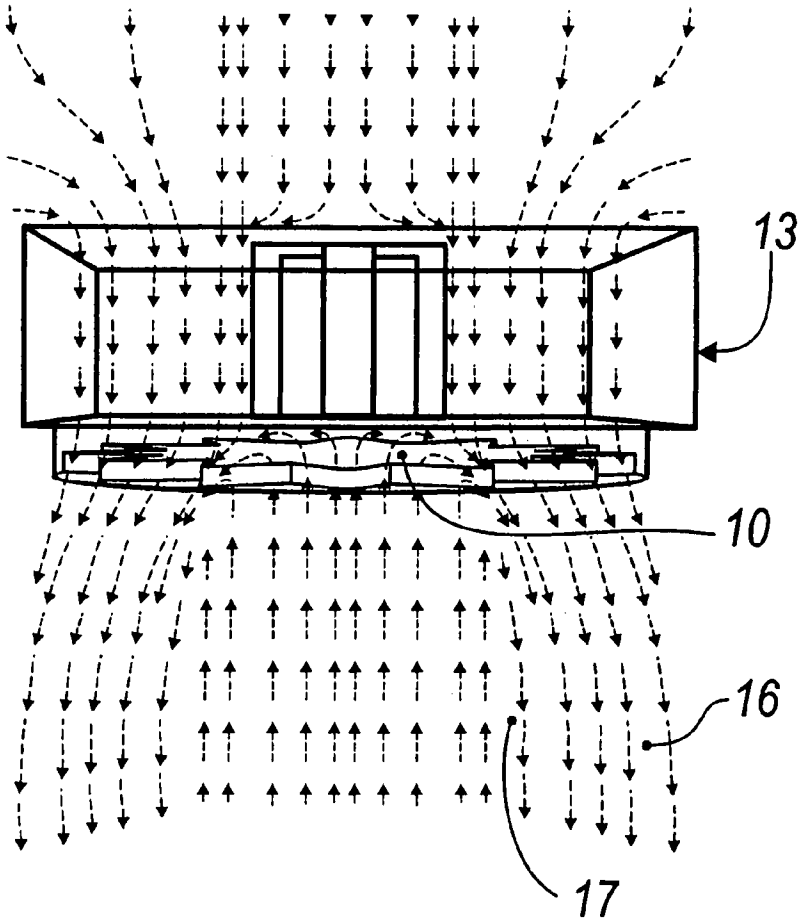
FIG. 5 is a side view of a measurement of the behavior of the air flow determined by an axial fan provided with a straightener according to the invention.

FIG. 5 illustrates the same side view as FIG. 4, related to the axial fan 13 provided with the straightener 10 according to the invention.

In said figure, the profile 16 of the faster air flow is substantially cylindrical and the recirculation regions 17 are greatly reduced.

In practice it has been found that the invention thus described solves the problems noted in known types of flow straightener for axial fans.

In particular, the present invention provides a flow straightener which is capable of reducing the problems cited above linked to the correct operation of a ceiling-mounted conditioning unit with vertical axial fan.

The present invention in fact provides a straightener which limits parasitic air recirculations, making the air flow that exits from the axial fan less conical than the air flows that exit from known types of straightener, as clearly shown by the comparison between FIGS. 4 and 5.

Further, the present invention provides a flow straightener which improves stratification of the air in the enclosed space in which the conditioning unit with which it is associated works.

Moreover, the present invention provides a flow straightener which can also be applied to existing and operating conditioning units.

Moreover, the present invention provides a flow straightener for axial fans particularly for conditioning systems which can be manufactured cheaply with known systems and technologies.

The term "substantially" as herein used, is intended to mean that the elements to which it refers have the characteristic as indicated but for dimensional tolerances which are known as normal in the pertinent technical field.

In practice, the materials employed, so long as they are compatible with the specific use, as well as the dimensions, may be any according to requirements and to the state of the art.

The disclosures in Italian Utility Model Application No. PD2006U000005 from which this application claims priority are incorporated herein by reference.

What is claimed is:

1. In an axial fan of a conditioning air system, the axial fan having an air exit region and an impeller that is rotatable about an axis thereof and generates an output air flow at said exit region, a flow straightener comprising a plurality of flat deflection walls which are arranged so as to form a substantially star-shaped element with a continuous profile that has a thickness extension that is formed by height extensions of said flat deflection walls, said thickness extension extending in a direction of a central axis of said element, and wherein said flow straightener is connected to the axial fan co axially to and proximate to the impeller with said thickness extension lying in a direction of the axis of the impeller so that said flat deflection walls shape in use the output air flow generated by said impeller to have a substantially cylindrical profile.

2. The axial fan with flow straightener of claim 1, wherein said flat walls are each constituted by a metallic lamina which is joined at ends thereof to a contiguous additional one of said walls so as to form a series of consecutive vertices which are directed alternately toward an inside and toward an outside region of the star-shaped element formed by said walls.

3. The axial fan with flow straightener of claim 2, wherein said vertices are substantially angular, two of said walls, which are provided straights, joining at said vertices.

4. The axial fan with flow straightener of claim 2, wherein said vertices are substantially angular and formed by one of said walls that is substantially straight and which joins a further one of said walls that has a curved shape.

5. The axial fan with flow straightener of claim 2, wherein said vertices are curved.

6. The axial fan with flow straightener of claim 1, wherein said element is made from a strip of metal plate that is suitably bent.

7. The axial fan with flow straightener of claim 1, made of molded plastic material.

8. An axial fan of a conditioning air system, the axial fan having a downward air exit region and an impeller that is rotatable about a vertical axis thereof to generate a descending output of air flow at said downward exit region, in combination with a flow straightener comprising a plurality of flat deflection walls which are arranged so as to form a substantially star-shaped element with a continuous profile that has a thickness extension that is formed by height extensions of said flat deflection walls, said thickness extension extending in a direction of a central axis of said element, and wherein said flow straightener is connected to the axial fan coaxially to and proximate to the impeller with said thickness extension extending vertically so that said flat deflection walls shape in use the descending output air flow generated by said impeller to have a substantially cylindrical profile.

* * * * *